US011207887B2

(12) United States Patent
Taniuchi et al.

(10) Patent No.: US 11,207,887 B2
(45) Date of Patent: Dec. 28, 2021

(54) LIQUID EJECTING HEAD AND LIQUID EJECTING SYSTEM

(71) Applicant: SEIKO EPSON CORPORATION, Tokyo (JP)

(72) Inventors: Akinori Taniuchi, Matsumoto (JP); Akira Miyagishi, Matsumoto (JP); Toshiro Murayama, Fujimi-machi (JP); Shotaro Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/918,146

(22) Filed: Jul. 1, 2020

(65) Prior Publication Data

US 2021/0001630 A1 Jan. 7, 2021

(30) Foreign Application Priority Data

Jul. 4, 2019 (JP) ..... JP2019-125071

(51) Int. Cl.
*B41J 2/14* (2006.01)
*B41J 2/175* (2006.01)

(52) U.S. Cl.
CPC *B41J 2/14* (2013.01); *B41J 2/175* (2013.01)

(58) Field of Classification Search
CPC . B41J 2/14; B41J 2/175; B41J 2/14233; B41J 2202/12; B41J 2002/14241; B41J 2002/14419; B41J 2002/14491; B41J 2002/14475; B41J 2/17509; B41J 2/01; B41J 2/04501; B41J 2/14201
See application file for complete search history.

(56) References Cited

U.S. PATENT DOCUMENTS

2018/0170049 A1* 6/2018 Taniuchi ..... B41J 2/14201
2019/0366717 A1 12/2019 Tsukahara et al.

FOREIGN PATENT DOCUMENTS

JP 2018-103602 7/2018

OTHER PUBLICATIONS

IP.com search (Year: 2021).*
Machine Translation of JP 2018103602 A, Tsukahara, Katsutomo et al., pp. 7 and 14-16 (Year: 2018).*

* cited by examiner

*Primary Examiner* — Lisa Solomon
(74) *Attorney, Agent, or Firm* — Workman Nydegger

(57) ABSTRACT

A liquid ejecting head includes a first flow path extending in a first axial direction between a supply port and a discharge port, and a nozzle that is provided to branch from the first flow path and that discharges a liquid along a second axial direction orthogonal to the first axial direction. The nozzle includes a first nozzle portion in which a first opening for discharging the liquid is formed and a second nozzle portion in which a second opening that is a coupling port with the first flow path is formed, and a diameter r2 of the second opening in the first axial direction is larger than a diameter r1 of the first opening in the first axial direction.

20 Claims, 9 Drawing Sheets

LIQUID EJECTING HEAD AND LIQUID EJECTING SYSTEM

The present application is based on, and claims priority from JP Application Serial Number 2019-125071, filed Jul. 4, 2019, the disclosure of which is hereby incorporated by reference herein in its entirety.

BACKGROUND

1. Technical Field

The present disclosure relates to a liquid ejecting head and a liquid ejecting system that eject liquid from a nozzle, and more particularly, to an ink jet recording head and an ink jet recording system that eject ink as a liquid.

2. Related Art

There has been proposed a liquid ejecting system that circulates liquid inside a liquid ejecting head that ejects the liquid. The liquid ejecting system circulates the liquid to, for example, discharge bubbles contained in the liquid, suppress an increase in the viscosity of the liquid, and suppress settling of a component contained in the liquid in the liquid ejecting head (for example, refer to JP-A-2018-103602).

In the liquid ejecting head of JP-A-2018-103602, the liquid inside the liquid ejecting head is circulated through a branched flow path provided in the vicinity of the nozzles, thereby suppressing an increase in the viscosity caused by drying of the liquid not ejected from the nozzles.

However, there is a desire for a liquid ejecting head capable of more efficiently replacing the liquid in the vicinity of the nozzles.

This problem exists not only in an ink jet recording head but also similarly in a liquid ejecting head that ejects a liquid other than the ink.

SUMMARY

An advantage of some aspects of the present disclosure is to provide a liquid ejecting head and a liquid ejecting system capable of more efficiently replacing liquid in the vicinity of nozzles.

According to an aspect of the present disclosure, there is provided a liquid ejecting head including a first flow path extending in a first axial direction between a supply port and a discharge port, and a nozzle that is provided to branch from the first flow path and that discharges a liquid along a second axial direction orthogonal to the first axial direction, in which the nozzle includes a first nozzle portion in which a first opening for discharging the liquid is formed and a second nozzle portion in which a second opening that is a coupling port with the first flow path is formed, and a diameter r2 of the second opening in the first axial direction is larger than a diameter r1 of the first opening in the first axial direction.

According to another aspect of the present disclosure, there is provided a liquid ejecting system including the liquid ejecting head and a mechanism configured to supply a liquid to the supply port, collect the liquid from the discharge port, and circulate the liquid.

DESCRIPTION OF EXEMPLARY EMBODIMENTS

Figure 1:
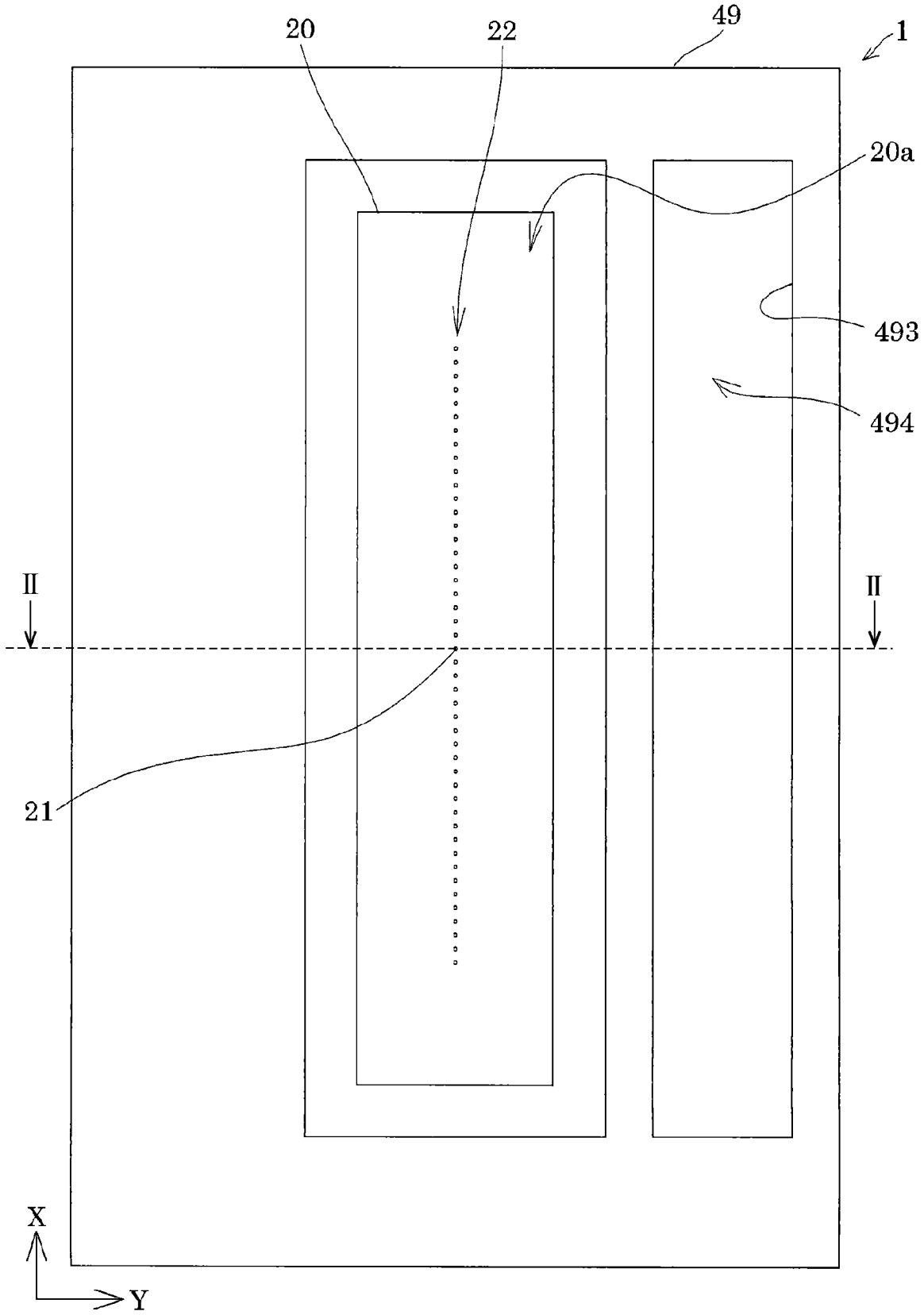
FIG. 1 is a plan view of a recording head according to Embodiment 1.

Hereinafter, the present disclosure will be described in detail based on the embodiments. However, the following description illustrates an embodiment of the present disclosure and may be optionally changed within the scope of the present disclosure. In the drawings, the same reference numerals denote the same members and the description thereof will be omitted as appropriate. In the drawings, X, Y, and Z represent three spatial axes orthogonal to each other. In the present specification, directions along these axes are defined as an X direction, a Y direction, and a Z direction. The directions of the arrows in the diagrams are illustrated as positive (+) directions and the directions opposite to the arrows are illustrated as negative (−) directions. The Z direction indicates a vertical direction, the +Z direction indicates vertically downward, and the −Z direction indicates vertically upward.

Embodiment 1

Figure 2:
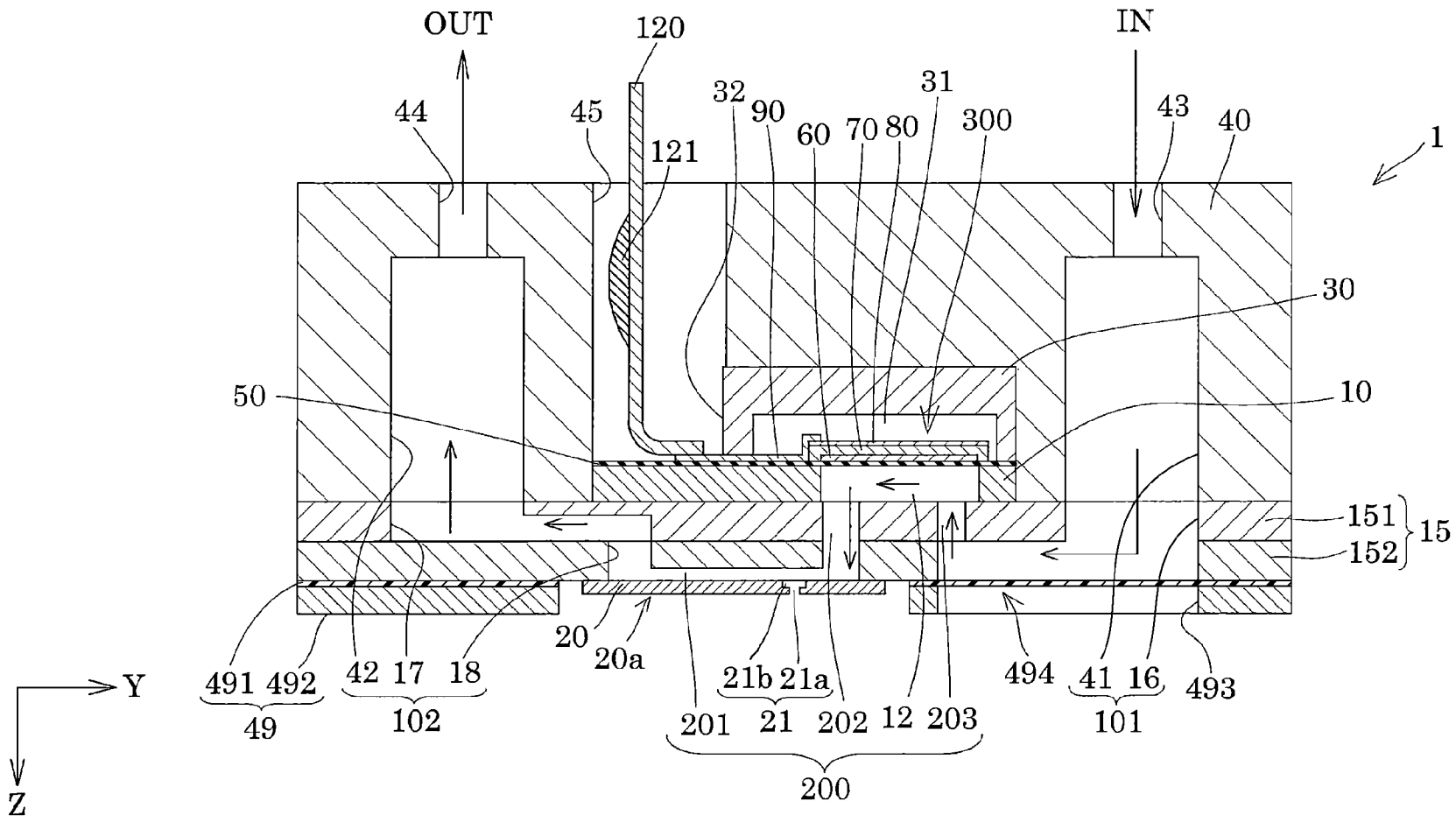
FIG. 2 is a sectional diagram of the recording head according to Embodiment 1.
Figure 3:
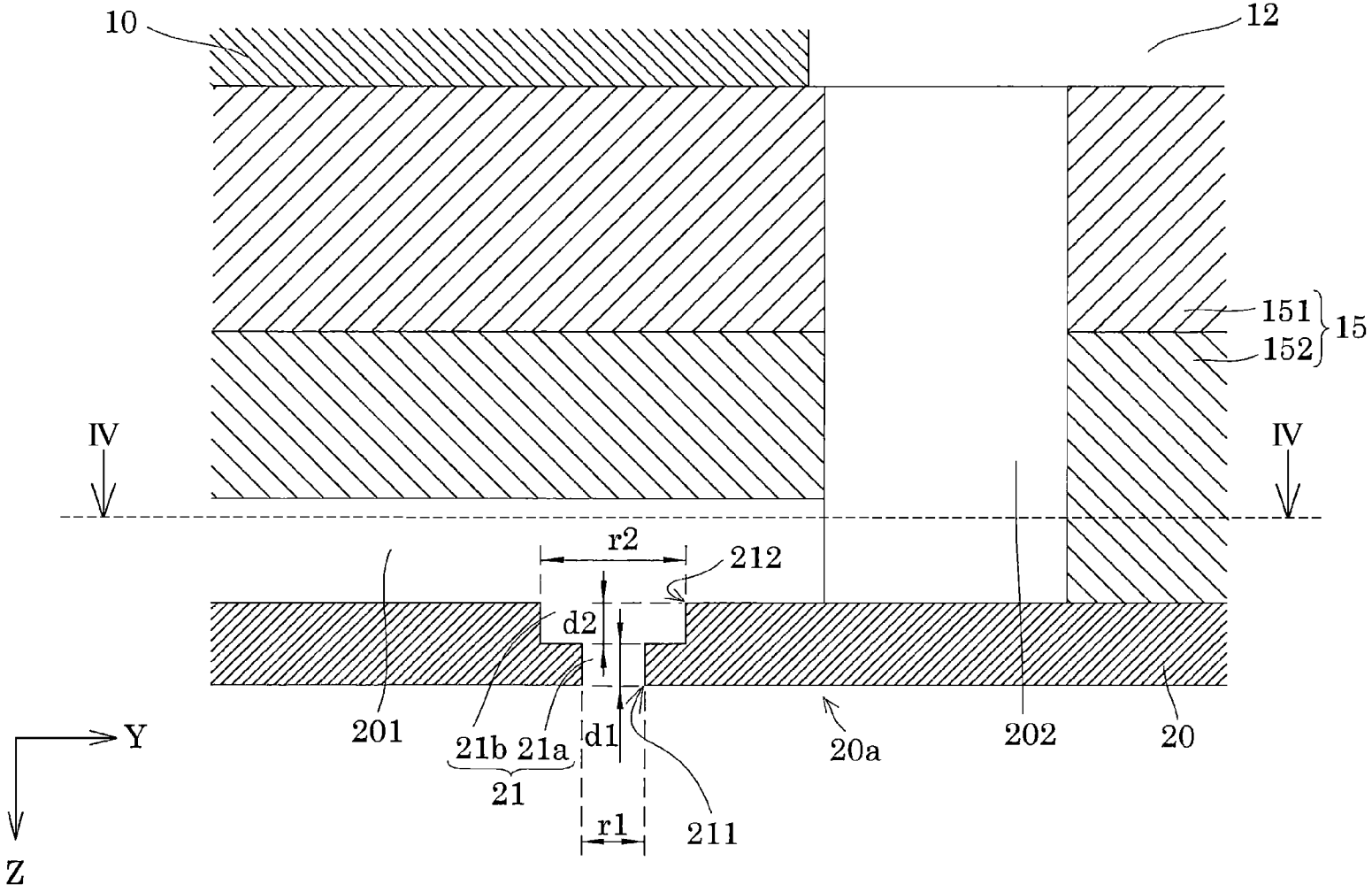
FIG. 3 is a sectional diagram of the recording head according to Embodiment 1.
Figure 4:
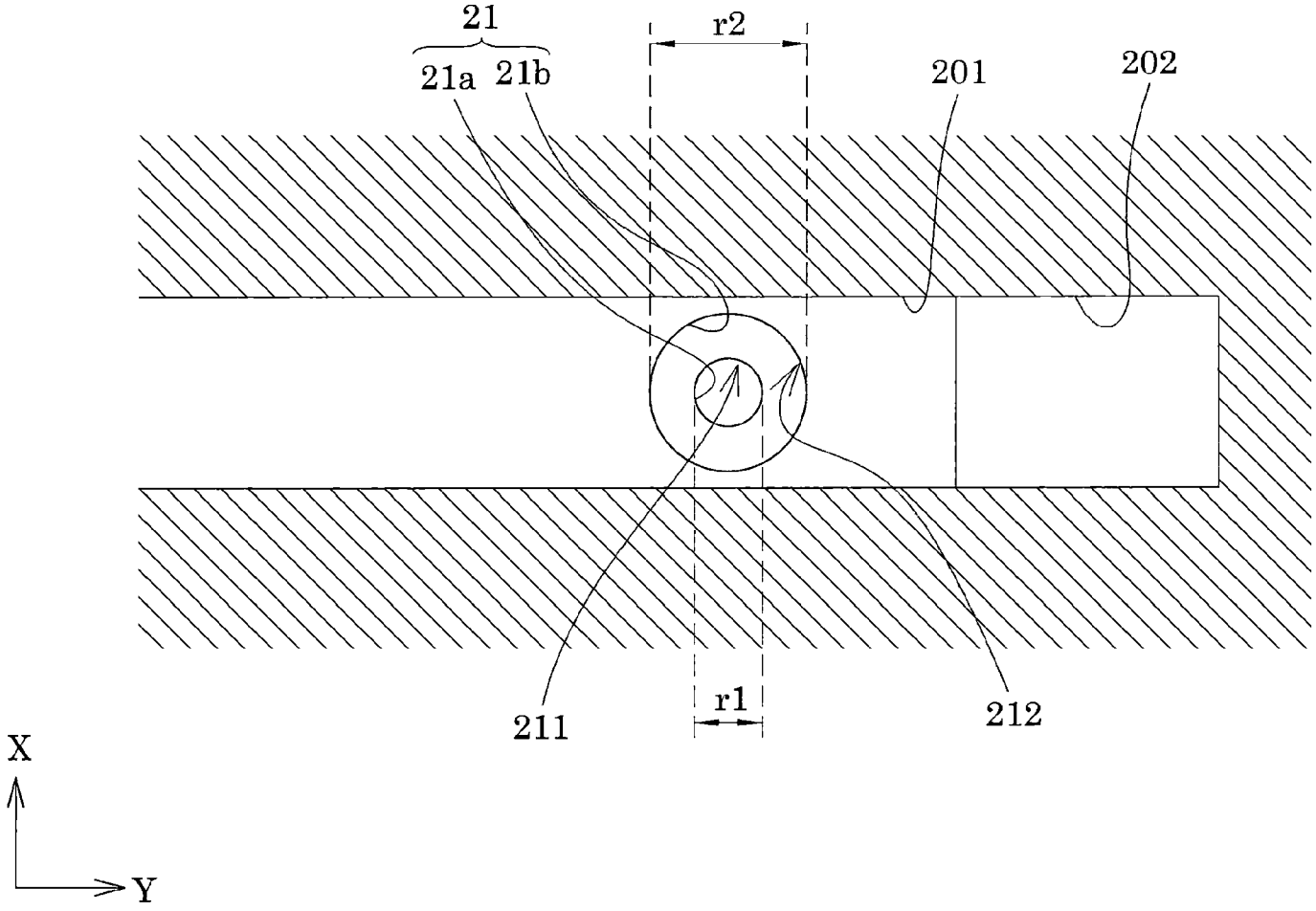
FIG. 4 is a sectional diagram of the recording head according to Embodiment 1.
Figure 5:
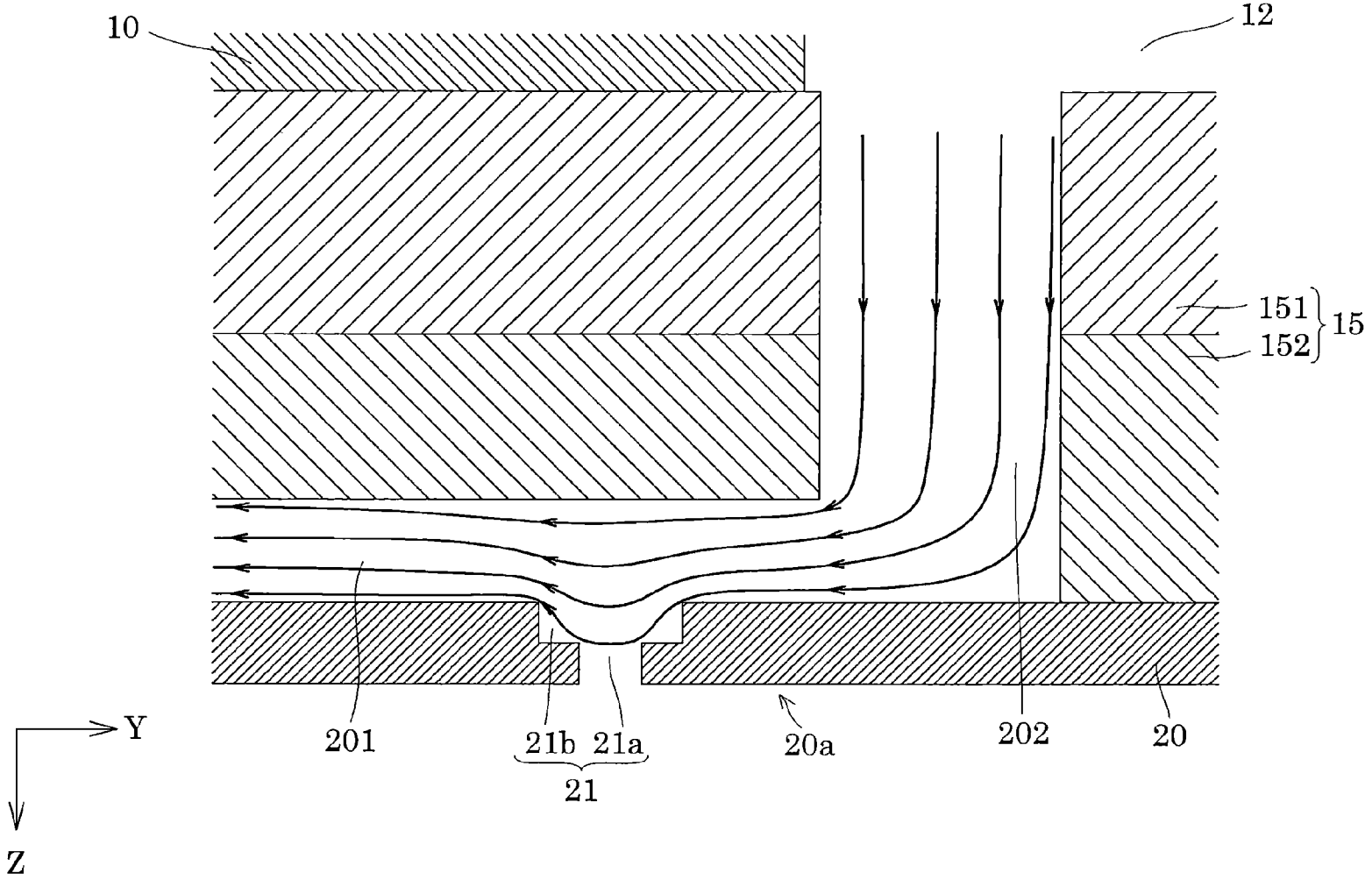
FIG. 5 is a sectional diagram illustrating streamlines of the recording head according to Embodiment 1.
Figure 6:
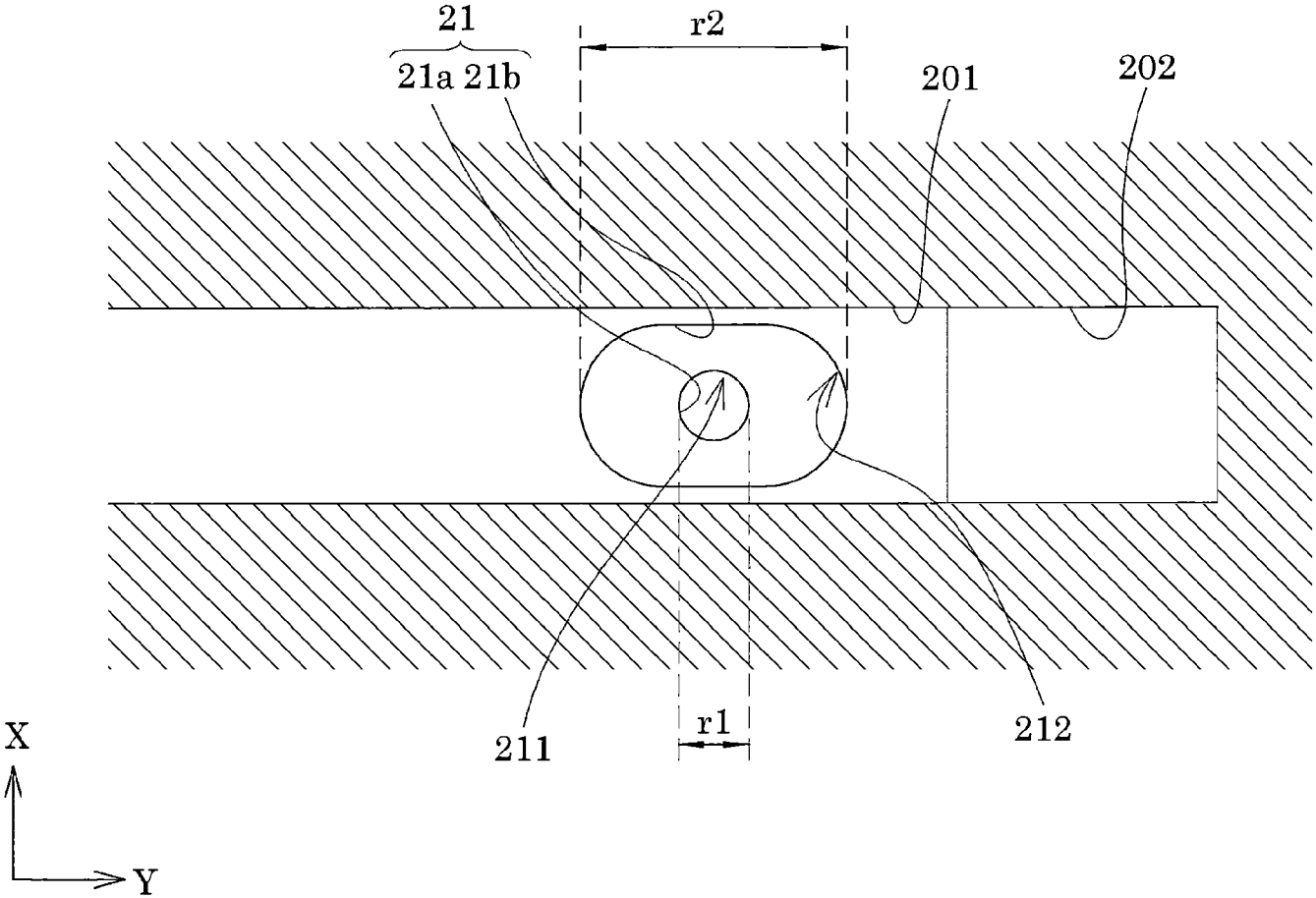
FIG. 6 is a sectional diagram of a recording head according to another embodiment.

An ink jet recording head, which is an example of the liquid ejecting head of the present embodiment, will be described with reference to FIGS. 1 to 6. FIG. 1 is a plan view of an ink jet recording head, which is an example of a liquid ejecting head according to Embodiment 1 of the present disclosure, as viewed from a nozzle surface side. FIG. 2 is a sectional diagram taken along line II-II of FIG. 1. FIG. 3 is an enlarged view of the main parts of FIG. 2. FIG. 4 is a sectional diagram taken along line IV-IV of FIG. 3. FIG. 5 is a diagram for explaining the streamlines inside the flow path of FIG. 3. FIG. 6 is a diagram illustrating the streamlines inside the flow path of a comparative example.

As illustrated in the drawings, an ink jet recording head 1 (hereinafter, also simply referred to as a recording head 1), which is an example of the liquid ejecting head of the present embodiment, is provided with members such as a flow path forming substrate 10 as flow path substrate, a communicating plate 15, a nozzle plate 20, a protection substrate 30, a case member 40, and a compliance substrate 49.

The flow path forming substrate 10 is formed of a silicon single crystal substrate and a diaphragm 50 is formed at one surface of the flow path forming substrate 10. The diaphragm 50 may be a single layer or a laminate selected from a silicon dioxide layer and a zirconium oxide layer.

The flow path forming substrate 10 is provided with pressure chambers 12 forming individual flow paths 200, the pressure chambers 12 being partitioned by partition walls. The pressure chambers 12 are arranged at a predetermined pitch along the X direction in which nozzles 21 that discharge the ink are arranged. In the present embodiment, one row of the pressure chambers 12 is provided such that the pressure chambers 12 are arranged in the X direction. The flow path forming substrate 10 is disposed such that the in-plane direction includes the X direction and the Y direction. In the present embodiment, the portions between the pressure chambers 12 arranged in the X direction of the flow path forming substrate 10 are referred to as partition walls. The partition walls are formed along the Y direction. In other words, the partition walls refer to portions overlapping the pressure chambers 12 in the Y direction of the flow path forming substrate 10.

Although the flow path forming substrate 10 is provided with only the pressure chambers 12 in the present embodiment, the flow path forming substrate 10 may be provided with a flow path resistance imparting portion having a narrower cross-sectional area crossing the flow paths than the pressure chambers 12 so as to impart the ink to be supplied to the pressure chambers 12 with a flow path resistance.

Piezoelectric actuators 300 are configured by forming the diaphragms 50 on one side of the flow path forming substrate 10 in the −Z direction and by laminating first electrodes 60, piezoelectric layers 70, and second electrodes 80 on the diaphragm 50 using film formation and lithography. In the present embodiment, the piezoelectric actuator 300 is an energy generating element that generates pressure changes in the ink inside the pressure chamber 12. Here, the piezoelectric actuator 300 is also referred to as a piezoelectric element and refers to a portion including the first electrode 60, the piezoelectric layer 70, and the second electrode 80. In general, one of the electrodes of the piezoelectric actuator 300 is used as a common electrode and the other electrode and the piezoelectric layer 70 are patterned for each pressure chamber 12. In the present embodiment, although the first electrode 60 is used as the common electrode of the piezoelectric actuator 300 and the second electrode 80 is used as the individual electrode of the piezoelectric actuator 300, there is no impediment to reversing this configuration in consideration of the drive circuit and wiring. In the example described above, although the diaphragm 50 and the first electrode 60 act as a diaphragm, the configuration is not limited thereto. For example, a configuration may be adopted in which the diaphragm 50 is not provided and only the first electrode 60 acts as a diaphragm. The piezoelectric actuator 300 itself may substantially serve as the diaphragm.

A respective lead electrode 90 is coupled to the second electrode 80 of each of the piezoelectric actuators 300 and a voltage is selectively applied to each of the piezoelectric actuators 300 via the lead electrodes 90.

The protection substrate 30 is joined to the −Z direction surface of the flow path forming substrate 10.

A piezoelectric actuator holding portion 31 having enough space to not hinder the motion of the piezoelectric actuator 300 is provided in a region of the protection substrate 30 facing the piezoelectric actuator 300. The piezoelectric actuator holding portion 31 only needs to have enough space to not hinder the motion of the piezoelectric actuator 300 and the space may be sealed or not sealed. The piezoelectric actuator holding portion 31 is formed to have a size that integrally covers the row of the piezoelectric actuators 300 arranged in the X direction. Naturally, the piezoelectric actuator holding portion 31 is not particularly limited to this configuration, and may individually cover the piezoelectric actuators 300, and may cover each group configured of two or more piezoelectric actuators 300 arranged in the X direction.

For the protection substrate 30, it is preferable to use a material having substantially the same coefficient of thermal expansion as the flow path forming substrate 10, for example, glass, ceramic material, or the like. In the present embodiment, a silicon single crystal substrate of the same material as the material of the flow path forming substrate 10 is used to form the protection substrate 30.

The protection substrate 30 is provided with a through-hole 32 extending through the protection substrate 30 in the Z direction. The end portion of the lead electrode 90 extending from each of the piezoelectric actuators 300 is provided to extend so as to be exposed inside the through-hole 32 and is electrically coupled to a flexible cable 120 inside the through-hole 32. The flexible cable 120 is a flexible wiring substrate, and in the present embodiment, a drive circuit 121 which is a semiconductor element is mounted to the flexible cable 120. The lead electrode 90 and the drive circuit 121 may be electrically coupled to each other without being coupled via the flexible cable 120. A flow path may be provided in the protection substrate 30.

The case member 40 that partitions a supply flow path communicating with the pressure chambers 12 and that partitions the protection substrate 30 is fixed onto the protection substrate 30. The case member 40 is joined to a surface of the protection substrate 30 on the side opposite from the flow path forming substrate 10 and is also joined to the communicating plate 15 (described later).

The case member 40 is provided with a first liquid chamber portion 41 that forms part of a first common liquid chamber 101 and a second liquid chamber portion 42 that forms part of a second common liquid chamber 102. The first liquid chamber portion 41 and the second liquid chamber portion 42 are provided in the Y direction on both sides of one row of the pressure chambers 12.

Each of the first liquid chamber portion 41 and the second liquid chamber portion 42 has a concave shape opened on the −Z side surface of the case member 40 and is provided continuously to extend over the pressure chambers 12 arranged in the X direction.

The case member 40 is provided with a supply port 43 that communicates with the first liquid chamber portion 41 to supply the ink to the first liquid chamber portion 41 and a discharge port 44 that communicates with the second liquid chamber portion 42 and discharges the ink from the second liquid chamber portion 42.

Furthermore, the case member 40 is further provided with a coupling port 45 which communicates with the through-hole 32 of the protection substrate 30 and through which the flexible cable 120 is inserted.

On the other hand, the communicating plate 15, the nozzle plate 20, and the compliance substrate 49 are provided on the +Z side of the flow path forming substrate 10 which is the side opposite from the protection substrate 30.

Nozzles 21 that eject the ink in the +Z direction of the Z direction which is the second axial direction are formed in the nozzle plate 20. In the present embodiment, as illustrated in FIG. 1, the nozzles 21 are disposed in a straight line along the X direction, thereby forming one nozzle row 22. The surface of the nozzle plate 20 on the +Z side in which the nozzles 21 open is referred to as a nozzle surface **20*a*. The nozzles 21** will be described later in detail.

The communicating plate 15 includes a first communicating plate 151 and a second communicating plate 152 in the present embodiment. The first communicating plate 151 and the second communicating plate 152 are laminated in the Z direction such that the first communicating plate 151 is on the −Z side and the second communicating plate 152 is on the +Z side.

The first communicating plate 151 and the second communicating plate 152 which form the communicating plate 15 may be made of a metal such as stainless steel, glass, a ceramic material, or the like. It is preferable that the communicating plate 15 be formed by using a material having substantially the same thermal expansion coefficient as that of the flow path forming substrate 10. In the present embodiment, the communicating plate 15 is formed by using a silicon single crystal substrate of the same material as the material of the flow path forming substrate 10.

The communicating plate 15 is provided with a first communicating portion 16 which communicates with the first liquid chamber portion 41 of the case member 40 to form a portion of the first common liquid chamber 101, and a second communicating portion 17 and a third communicating portion 18 which communicate with the second liquid chamber portion 42 of the case member 40 to form a portion of the second common liquid chamber 102. As will be described in detail later, the communicating plate 15 is provided with a flow path that communicates the first common liquid chamber 101 and the pressure chamber 12 with each other, a flow path that communicates the pressure chamber 12 and the nozzle 21 with each other, and a flow path that communicates the nozzle 21 with the second common liquid chamber 102 with each other. The flow paths provided in the communicating plate 15 form a portion of the individual flow path 200.

The first communicating portion 16 is provided at a position overlapping the first liquid chamber portion 41 of the case member 40 in the Z direction and is provided to extend through the communicating plate 15 in the Z direction to be opened in both the +Z side surface and the −Z side surface of the communicating plate 15. The first communicating portion 16 forms a first common liquid chamber 101 by communicating with the first liquid chamber portion 41 on the −Z side. In other words, the first common liquid chamber 101 is formed by the first liquid chamber portion 41 of the case member 40 and the first communicating portion 16 of the communicating plate 15. The first communicating portion 16 extends in the −Y direction to a position overlapping the pressure chamber 12 in the Z direction on the +Z side. The first common liquid chamber 101 may be formed by the first liquid chamber portion 41 of the case member 40 without providing the first communicating portion 16 in the communicating plate 15.

The second communicating portion 17 is provided at a position overlapping the second liquid chamber portion 42 of the case member 40 in the Z direction and is provided to be open on the −Z side surface of the first communicating plate 151. The second communicating portion 17 is provided to widen toward the nozzle 21 in the +Y direction on the +Z side.

The third communicating portion 18 is provided to extend through the second communicating plate 152 in the Z direction such that one end of the third communicating portion 18 communicates with a portion of the second communicating portion 17 that is widened in the +Y direction. The opening on the +Z side of the third communicating portion 18 is covered by the nozzle plate 20. In other words, by providing the second communicating portion 17 on the first communicating plate 151, only the opening on the +Z side of the third communicating portion 18 may be covered by the nozzle plate 20, and thus, it is possible to provide the nozzle plate 20 in a relatively small area and it is possible to reduce the cost.

The second common liquid chamber 102 is formed by the second communicating portion 17 and the third communicating portion 18 provided in the communicating plate 15 and the second liquid chamber portion 42 provided in the case member 40. The second common liquid chamber 102 may be formed by the second liquid chamber portion 42 of the case member 40 without providing the second communicating portion 17 and the third communicating portion 18 in the communicating plate 15.

The compliance substrate 49 including a compliance portion 494 is provided on a surface of the communicating plate 15 on the +Z side in which the first communicating portion 16 is opened. The compliance substrate 49 seals the opening of the first common liquid chamber 101 on a nozzle surface 20*a* side.

In the present embodiment, the compliance substrate 49 includes a sealing film 491 formed of a thin flexible film and a fixed substrate 492 formed of a hard material such as a metal. Since the region of the fixed substrate 492 facing the first common liquid chamber 101 is an opening portion 493 completely removed in the thickness direction, a portion of the wall surface of the first common liquid chamber 101 is the compliance portion 494 which is a flexible portion sealed only by the flexible sealing film 491. By providing the compliance portion 494 on a portion of the wall surface of the first common liquid chamber 101 in this manner, it is possible to absorb the pressure fluctuation of the ink inside the first common liquid chamber 101 by the compliance portion 494 being deformed.

The flow path forming substrate 10, the communicating plate 15, the nozzle plate 20, the compliance substrate 49, and the like which form the flow path substrate are provided with the individual flow paths 200 which communicate with the first common liquid chamber 101 and the second common liquid chamber 102 and through which the ink in the first common liquid chamber 101 flows to the second common liquid chamber 102. Here, each of the individual flow paths 200 of the present embodiment is provided for corresponding one of the nozzles 21 in communication with the first common liquid chamber 101 and the second common liquid chamber 102, and includes the nozzle 21. The individual flow paths 200 are arranged along the X direction, which is the direction in which the nozzles 21 are arranged. Two of the individual flow paths 200 adjacent in the X direction, which is the direction in which the nozzles 21 are arranged, are provided to communicate with the first common liquid chamber 101 and the second common liquid chamber 102, respectively. In other words, the individual flow paths 200 provided for the nozzles 21 are provided in communication only with the first common liquid chamber 101 and the second common liquid chamber 102, respectively, and the individual flow paths 200 do not communicate with each other except by the first common liquid chamber 101 and the second common liquid chamber 102. In other words, in the present embodiment, a flow path provided with one nozzle 21 and one pressure chamber 12 is referred to as the individual flow path 200, and each of the individual flow paths 200 is provided to communicate with the other individual flow paths 200 only by the first common liquid chamber 101 and the second common liquid chamber 102.

As illustrated in FIGS. 2 and 3, the individual flow path 200 includes the nozzle 21, the pressure chamber 12, a first flow path 201, a second flow path 202, and a supply path 203.

The pressure chamber 12 is provided between the recessed portion provided in the flow path forming substrate 10 and the communicating plate 15 as described above and extends in the Y direction. In other words, the pressure chamber 12 is provided such that the supply path 203 is coupled to one end portion of the pressure chamber 12 in the Y direction, the second flow path 202 is coupled to the other end portion in the Y direction, and the ink flows inside the pressure chamber 12 in the Y direction. In other words, the direction in which the pressure chamber 12 extends refers to the direction in which the ink flows inside the pressure chamber 12.

In the present embodiment, only the pressure chamber 12 is formed in the flow path forming substrate 10. However, the configuration is not limited thereto, and the upstream end portion of the pressure chamber 12, that is, the end portion in the +Y direction may be provided with the flow path resistance imparting portion having the cross-sectional area narrower than that of the pressure chamber 12 to impart flow path resistance.

The supply path 203 couples the pressure chamber 12 to the first common liquid chamber 101 and is provided to extend through the first communicating plate 151 in the Z direction. The supply path 203 communicates with the first common liquid chamber 101 at the end portion on the +Z side and communicates with the pressure chamber 12 at the end portion on the −Z side. In other words, the supply path 203 extends in the Z direction. Here, the direction in which the supply path 203 extends refers to the direction in which the ink flows inside the supply path 203.

The first flow path 201 is provided to extend between the supply port 43 and the discharge port 44 in the Y direction. The direction in which the first flow path 201 extends refers to the direction in which the ink flows inside the first flow path 201. In other words, the first axial direction in which the first flow path 201 extends is the Y direction in the present embodiment. The +Y direction end portion of the first flow path 201 communicates with the second flow path 202 and the −Y direction end portion of the second flow path 202 communicates with the third communicating portion 18 of the second common liquid chamber 102.

The first flow path 201 of the present embodiment is provided between the second communicating plate 152 and the nozzle plate 20. Specifically, the first flow path 201 is formed by providing a recessed portion in the second communicating plate 152 and covering the opening of the recessed portion with the nozzle plate 20. The first flow path 201 is not particularly limited to this configuration and a recessed portion may be provided in the nozzle plate 20 and the recessed portion of the nozzle plate 20 may be covered with the second communicating plate 152, or alternatively, a recessed portion may be provided in both the second communicating plate 152 and the nozzle plate 20.

In the present embodiment, the first flow path 201 is provided such that a cross-sectional area crossing the ink flowing through the flow path, that is, a cross-sectional area in the plane direction including the X direction and the Z direction has the same area over the Y direction. That is, the cross-sectional area of the first flow path 201 crossing the flow path is provided to have the same area over the Y direction refers to a portion excluding a protruding portion 153 described later in detail. The first flow path 201 may be provided such that the flow path-crossing cross-sectional area has a different area over the Y direction. The difference in the area crossing the first flow path 201 includes a case in which the height in the Z direction is different, a case in which the width in the X direction is different, and a case in which both are different.

The flow path-crossing cross-sectional shape of the first flow path 201, that is, the cross-sectional shape in the plane direction including the X direction and the Z direction is rectangular. The flow path-crossing cross-sectional shape of the first flow path 201 is not particularly limited, and may be a trapezoid, a semicircle, a semi-ellipse, or the like.

The second flow path 202 is provided to extend between the pressure chamber 12 and the first flow path 201 in the Z direction. The direction in which the second flow path 202 extends is the direction in which the ink inside the second flow path 202 flows. In other words, in the present embodiment, the direction in which the second flow path 202 extends is the Z direction which is the same as the second axial direction. In the present embodiment, the second flow path 202 is provided to extend through the communicating plate 15 in the Z direction, communicates with the pressure chamber 12 at an end portion in the −Z direction, and communicates with the first flow path 201 at an end portion in the +Z direction.

The second flow path 202 refers to a portion formed in the communicating plate 15. In other words, the second flow path 202 extends from the bottom surface of the pressure chamber 12 in the +Z direction to the portion covered by the nozzle plate 20.

The nozzle plate 20 is provided with the nozzles 21. Each of the nozzles 21 is disposed at a position communicating with the middle of the corresponding first flow path 201. In other words, the nozzle 21 is provided to branch in the +Z direction from the first flow path 201 extending in the Y direction. Accordingly, ink droplets are discharged from the nozzle 21 toward the +Z direction of the Z direction which is the second axial direction. In other words, the nozzle 21 is provided to extend through the nozzle plate 20 in the Z direction such that the end portion of the nozzle 21 in the −Z direction communicates with the middle of the first flow path 201 and the end portion of the nozzle 21 in the +Z direction opens to the nozzle surface 20*a*, which is the +Z side surface of the nozzle plate 20. Therefore, the second axial direction in which the nozzle 21 ejects ink droplets is the +Z direction.

Here, the nozzle 21 being provided to branch from the first flow path 201 means that the nozzle 21 communicates with the middle of the first flow path 201. The nozzle 21 communicating with the middle of the first flow path 201 means that the nozzle 21 is disposed at a position overlapping the first flow path 201 when viewed in plan view in the Z direction. When the nozzle 21 is disposed at a position overlapping the second flow path 202 when viewed in plan view in the Z direction, the nozzle 21 is not considered to be provided to communicate with the middle of the first flow path 201. In other words, the first flow path 201 of the present embodiment is a portion that does not overlap the second flow path 202 when viewed in plan view in the Z direction.

It is preferable that the cross-sectional area crossing the ink flowing through the first flow path 201 with which the nozzle 21 communicates be smaller than the cross-sectional area crossing the ink flowing through the second flow path 202. The cross-sectional area crossing the first flow path 201 referred to here is the area of a cross-section in the plane direction including the X direction and the Z direction. The cross-sectional area crossing the second flow path 202 is the area of a cross-section in the plane direction including the Y direction and the Z direction. In this manner, by making the cross-sectional area of the first flow path 201 relatively small, it is possible to dispose the individual flow paths 200 densely in the X direction to densely dispose the nozzles 21 in the X direction, and it is possible to suppress an increase in the size of the recording head 1 in the Z direction. By making the cross-sectional area of the second flow path 202 relatively large, it is possible to suppress a decrease in the flow path resistance from the pressure chamber 12 to the nozzle 21 to suppress reductions in the discharging properties of the liquid, in particular, in the weight of the droplets to be discharged. In particular, by widening the second flow path 202 in the Y direction to increase the cross-sectional area of the second flow path 202, it is possible to reduce the flow path resistance in the second flow path 202 and it is possible to suppress a decrease in the density at which the individual flow paths 200 are disposed to dispose the individual flow paths 200 at a high density. In the present embodiment, the first flow path 201 and the second flow path 202 are provided with the same width in the X direction, and the width of the second flow path 202 in the Y direction is larger than the height of the first flow path 201 in the Z direction, and thus, the cross-sectional area of the first flow path 201 is rendered smaller than the cross-sectional area of the second flow path 202. Accordingly, it is possible to increase the cross-sectional area of the second flow path 202 and to dispose the first flow paths 201 and the second flow paths 202 at a high density in the X direction.

The nozzle 21 is formed in a member different from the member in which the first flow path 201 is provided, that is, different from the communicating plate 15 in the present embodiment, and is formed in the nozzle plate 20 in the present embodiment.

Here, the nozzle 21 includes a first nozzle portion 21*a* and a second nozzle portion 21*b* disposed next to each other in the Z direction which is the plate thickness direction of the nozzle plate 20.

The first nozzle portion 21*a* is disposed outside, that is, on the +Z side of the nozzle plate 20 and is provided with a first opening 211 through which ink droplets are discharged. In other words, ink droplets are discharged outward in the +Z direction from the first opening 211 on the +Z side of the first nozzle portion 21*a* of the nozzle plate 20.

In the present embodiment, the first nozzle portion 21*a* is provided to have the same shape as the first opening 211 over the Z direction. Here, the first nozzle portion 21*a* being provided to have the same shape as the first opening 211 in the Z direction means that the cross-sectional shape and the cross-sectional area including the X direction and the Y direction of the first nozzle portion 21*a* are the same over the Z direction. In the present embodiment, the first opening 211 is provided to have a circular shape when viewed in plan view in the Z direction. Naturally, the shape of the first opening 211 is not particularly limited thereto, and may be an ellipse, a rectangle, a polygon, an egg shape, or the like.

The second nozzle portion 21*b* is disposed on the −Z side of the nozzle plate 20 and is provided with a second opening 212 that is a coupling port with the first flow path 201 extending in the Y direction described later in detail. In other words, the first axial direction, which is the extending direction of the first flow path 201, is the Y direction in the present embodiment. The Y direction which is the first axial direction and the Z direction which is the second axial direction are orthogonal to each other.

The second nozzle portion 21*b* is provided to have the same shape as the second opening 212 over the Z direction. Here, the second nozzle portion 21*b* being provided to have the same shape as the second opening 212 in the Z direction means that the cross-sectional shape and the cross-sectional area including the X direction and the Y direction of the second nozzle portion 21*b* are the same over the Z direction. Naturally, the second nozzle portion 21*b* is not limited to having the same opening shape over the Z direction and is provided such that the opening area gradually decreases toward the first nozzle portion 21*a*. In the present embodiment, the second opening 212 is provided to have a circular shape when viewed in plan view in the Z direction. Naturally, the shape of the second opening 212 is not particularly limited thereto, and may be an ellipse, a rectangle, a polygon, an egg shape, or the like.

A diameter r2 in the Y direction of the second opening 212 of the second nozzle portion 21*b* forming the nozzle 21 is larger than a diameter r1 in the Y direction of the first opening 211 of the first nozzle portion 21*a*. In other words, r2>r1. Here, the diameter r1 of the first opening 211 in the Y direction is the width dimension of the widest portion of the first opening 211 in the Y direction. The diameter r2 of the second opening 212 in the Y direction is the width dimension of the widest portion of the second opening 212 in the Y direction. In the present embodiment, the diameter in the X direction of the second opening 212 of the second nozzle portion 21*b* is larger than the diameter in the X direction of the first opening 211 of the first nozzle portion 21*a*. In other words, since the first nozzle portion 21*a* and the second nozzle portion 21*b* of the present embodiment have a circular shape in plan view in the Z direction, as illustrated in FIG. 4, the diameter r1 of the first nozzle portion 21*a* in the Y direction is the diameter of the first nozzle portion 21*a*, and the diameter r2 of the second nozzle portion 21*b* in the Y direction is the diameter of the second nozzle portion 21*b*. The first nozzle portion 21*a* and the second nozzle portion 21*b* are provided to have the same center when viewed in plan view in the Z direction, that is, the first opening 211 and the second opening 212 are provided to be concentric circles.

It is possible to improve the flow speed of the ink passing through the inside of the first nozzle portion 21*a* by providing the nozzle 21 with the first nozzle portion 21*a* having the diameter r1 smaller than the diameter r2 of the second nozzle portion 21*b* and it is possible to improve the flight speed of the ink droplet ejected from the nozzle 21. By providing the nozzle 21 with the second nozzle portion 21*b* having the diameter r2 larger than the diameter r1 of the first nozzle portion 21*a*, when circulation is performed in which the ink inside the individual flow path 200 is caused to flow from the first common liquid chamber 101 (described in detail later) toward the second common liquid chamber 102, it is possible to reduce the portion of the nozzle 21 that is not influenced by the circulation flow inside the nozzle 21. In other words, as illustrated in FIG. 5, it is possible to cause the ink flowing through the first flow path 201 during the circulation to enter the second nozzle portion 21*b* to generate a flow of the ink inside the second nozzle portion 21*b*. Accordingly, it is possible to increase the velocity gradient of the ink inside the nozzle 21 and replace the ink having an increased viscosity due to drying inside the nozzle 21 with new ink supplied from upstream. Therefore, it is possible to suppress displacement of the landing position on the ejection target medium caused by displacement of the flight direction of the ink droplet discharged from the nozzle 21 and the occurrence of discharging faults in which the ink droplet is not discharged from the nozzle 21 caused by an increase in the viscosity of the ink inside the nozzle 21.

However, when the diameter r2 of the second nozzle portion 21*b* is excessively large as compared with the diameter r1 of the first nozzle portion 21*a*, the ratio (M2/M1) of the inertance between the second nozzle portion 21*b* and the first nozzle portion 21*a* decreases, and the position of the meniscus of the ink inside the nozzle 21 is not stable when the ink droplets are continuously discharged. In other words, when the ratio of the inertance between the second nozzle portion 21*b* and the first nozzle portion 21*a* decreases, the meniscus of the ink moves to the second nozzle portion 21*b* without being retained inside the first nozzle portion 21*a* and it is no longer possible to continue the stable discharging of the ink droplets.

When the diameter r2 of the second nozzle portion 21*b* is excessively small, the ink flow inside the second nozzle portion 21*b* during the circulation is less likely to occur. When the diameter r2 of the second nozzle portion 21*b* is excessively small, the flow path resistance from the pressure chamber 12 to the nozzle 21 increases and the pressure loss increases, and the weight of the ink droplet discharged from the nozzle 21 thus decreases. Therefore, the piezoelectric actuator 300 is to be driven at a higher drive voltage and the discharging efficiency is reduced.

Therefore, r2/r1, which is the ratio of the diameter r2 of the second opening 212 to the diameter r1 of the first opening 211, is preferably greater than or equal to 2, and is more preferably greater than or equal to 2.5. In other words, r2/r1≥2 is preferable and r2/r1≥2.5 is more preferable.

The ratio r2/r1 of the diameter r2 of the second opening 212 to the diameter r1 of the first opening 211 is preferably less than or equal to 5, and is more preferably less than or equal to 3.5. In other words, r2/r1≥5 is preferable, and r2/r1≥3.5 is more preferable.

The ratio M2/M1 of an inertance M2 of the second nozzle portion 21*b* to an inertance M1 of the first nozzle portion 21*a* is preferably 0.28 to 0.9. In other words, 0.28 M2/M1≥0.9 is preferable.

Here, in general, it is possible to obtain the inertance M of the flow path by using the following equation (1), where S is the cross-sectional area, l is the length, and ρ is the density of the ink.

$$M = \frac{\rho l}{S} \tag{1}$$

In other words, the inertance M1 of the first nozzle portion 21*a* is ρd1/S1, where S1 is the cross-sectional area in the in-plane direction including the X direction and the Y direction of the first nozzle portion 21*a*, d1 is the length (depth) in the Z direction, and ρ is the density of the ink.

The inertance M2 of the second nozzle portion 21*b* is ρd2/S2, where S2 is the cross-sectional area in the in-plane direction including the X direction and the Y direction of the second nozzle portion 21*b*, d2 is the length (depth) in the Z direction, and ρ is the density of the ink.

As described above, by setting the ratio M2/M1 of the inertance M2 of the second nozzle portion 21*b* to the inertance M1 of the first nozzle portion 21*a* to less than or equal to 0.9, the flow of the ink is generated inside the second nozzle portion 21*b*, and it is possible to suppress the displacement of the landing position on the ejection target medium and discharging faults caused by an increase in the viscosity of the ink inside the nozzle 21. By setting the ratio M2/M1 of the inertance M2 of the second nozzle portion 21*b* to the inertance M1 of the first nozzle portion 21*a* to less than or equal to 0.9, a reduction in the weight of the ink droplet discharged from the nozzle 21 is suppressed, it is possible to drive the piezoelectric actuator 300 at a relatively low drive voltage, and it is possible to improve the discharging efficiency.

By setting the ratio M2/M1 of the inertance M2 of the second nozzle portion 21*b* to the inertance M1 of the first nozzle portion 21*a* to be greater than or equal to 0.28, the stability of the meniscus is improved and it is possible to suppress a reduction in the discharging stability of the ink droplets when the ink droplets are discharged continuously.

Furthermore, r2/d2 which is the ratio of the diameter r2 of the second opening 212 to the depth d2 of the second nozzle portion 21*b* is preferably greater than or equal to 1.5 and is more preferably greater than or equal to 3, where d2 is the depth of the second nozzle portion 21*b* in the Z direction, which is the second axial direction. In other words, r2/d2≥1.5 is preferable and r2/d2≥3 is more preferable.

In other words, by forming the second nozzle portion 21*b* to have a shape that is long in the Y direction and short in the Z direction in a cross section in the plane direction including the Z direction and the Y direction illustrated in FIG. 3, the ink flowing through the first flow path 201 in the Y direction easily enters the +Z side end portion of the second nozzle portion 21*b* that reaches the first nozzle portion 21*a*, and it is possible to generate a flow of the ink inside the second nozzle portion 21*b*.

It is possible to form the nozzle plate 20 by using, for example, a metal such as stainless steel (SUS), an organic material such as a polyimide resin, or a flat plate material such as silicon. The plate thickness of the nozzle plate 20 is preferably 60 μm to 100 μm. By using the nozzle plate 20 having such a plate thickness, it is possible to improve the handleability of the nozzle plate 20 and to improve the ease of assembly of the recording head 1. Although it is possible to reduce the size of a portion of the nozzle 21 that is not influenced by the circulation flow inside the nozzle 21 during the circulation of the ink by reducing the length of the nozzle 21 in the Z direction, it is necessary to reduce the thickness of the nozzle plate 20 in the Z direction in order to reduce the length of the nozzle 21 in the Z direction. When the thickness of the nozzle plate 20 is reduced in this manner, there is an increase in the likelihood of the rigidity of the nozzle plate 20 being reduced and the deformation of the nozzle plate 20 causing variation in the discharging direction of the ink droplets, and an increase in the likelihood of a reduction in the handleability of the nozzle plate 20 causing a reduction in the ease of assembly to occur. In other words, by using the nozzle plate 20 having a certain degree of thickness as described above, it is possible to suppress a reduction in the rigidity of the nozzle plate 20 and it is possible to suppress the occurrence of variation in the discharging direction cause by the deformation of the nozzle plate 20 and a reduction in the ease of assembly caused by a reduction in the handleability.

As described above, the ink jet recording head 1 which is an example of the liquid ejecting head of the present embodiment is provided with the first flow path 201 extending in the Y direction, which is the first axial direction, between the supply port 43 and the discharge port 44, and the nozzle 21 which is provided to branch from the first flow path 201 and is the nozzle 21 which discharges the ink along the Z direction, which is the second axial direction orthogonal to the Y direction, in which the nozzle 21 includes the first nozzle portion 21*a* in which the first opening 211 that discharges the ink is formed and the second nozzle portion 21*b* in which the second opening 212 which is the coupling port with the first flow path 201 is formed, and in which the diameter r2 of the second opening 212 in the Y direction is greater than the diameter r1 of the first opening 211 in the Y direction.

By causing the nozzle 21 to communicate with the middle of the first flow path 201 which extends in the Y direction in this manner, it is possible to dispose the nozzle 21 away from a portion at which the ink is retained, such as a corner portion between the second flow path 202 and the nozzle plate 20, and the ink and air bubbles in which a component settles due to the retaining do not easily move to the nozzle 21 side. Therefore, it is possible to suppress clogging of the nozzle 21 caused by the ink or bubbles in which the component settles due to the retaining, variation in the components of ink droplets to be discharged from the nozzle 21, and the like.

By causing the nozzle 21 to communicate with the middle of the first flow path 201 extending in the Y direction, it is possible to cause the air bubbles that enter from the nozzle 21 to flow toward the second common liquid chamber 102 on the downstream side using the ink flowing through the first flow path 201. Therefore, it is possible to prevent the bubbles that enter from the nozzle 21 from entering the pressure chamber 12 or the first common liquid chamber 101 side and to suppress ink droplet discharging faults caused by the pressure fluctuations of the ink inside the pressure chamber 12 being absorbed by the bubbles that enter the pressure chamber 12. When the nozzle 21 is provided at a position communicating with the second flow path 202, the bubbles entering from the nozzle 21 easily move to the pressure chamber 12 side against the flow of the ink due to buoyancy. When the bubbles enter the pressure chamber 12 from the nozzle 21, there is a concern that the bubbles that enter the pressure chamber 12 may absorb pressure fluctuations of the ink inside the pressure chamber 12 and that ink droplet discharging faults may occur.

By providing the nozzle 21 with the second nozzle portion 21*b* having the diameter r2 larger than the diameter r1 of the first nozzle portion 21*a*, the ink flowing inside the first flow path 201 in the Y direction is caused to enter the inside of the second nozzle portion 21*b* and it is possible to generate a flow of the ink inside the nozzle 21. By generating a flow of the ink inside the nozzle 21 in this manner, it is possible to replace the ink having an increased viscosity due to drying of the inside of the nozzle 21 with new ink supplied from upstream, it is possible to suppress the displacement of the landing position on the ejection target medium caused by the displacement of the flight direction of the ink droplet discharged from the nozzle 21 caused by increased-viscosity ink, and it is possible to suppress the occurrence of clogging of the nozzle 21.

It is possible to improve the flow speed of the ink passing through the inside of the first nozzle portion 21*a* by providing the first nozzle portion 21*a* having a smaller diameter r1 than the diameter r2 of the second nozzle portion 21*b* and it is possible to improve the flight speed of the ink droplet ejected from the nozzle 21.

By providing the nozzle 21 at a position communicating with the first flow path 201, it is possible to raise the degree of freedom in the disposing of the nozzle 21 in the Y direction.

In the recording head 1 of the present embodiment, the ratio r2/r1 of the diameter r2 of the second opening 212 to the diameter r1 of the first opening 211 is preferably greater than or equal to 2 and is more preferably greater than or equal to 2.5. As described above, the ratio r2/r1 of the diameter r2 of the second opening 212 to the diameter r1 of the first opening 211 is set to greater than or equal to 2, and more preferably greater than or equal to 2.5, and thus, it is possible to generate a flow of the ink inside the second nozzle portion 21*b* and to improve the flow speed of the ink by the first nozzle portion 21*a* to improve the flight speed of the ink droplet.

In the recording head 1 of the present embodiment, the ratio r2/r1 of the diameter r2 of the second opening 212 to the diameter r1 of the first opening 211 is preferably less than or equal to 5 and is more preferably less than or equal to 3.5. As described above, the ratio r2/r1 of the diameter r2 of the second opening 212 to the diameter r1 of the first opening 211 is set to less than or equal to 5, more preferably to less than or equal to 3.5, and thus, it is possible to suppress the ratio (M2/M1) of inertance of the second nozzle portion 21*b* to the first nozzle portion 21*a* becoming excessively small, and to stabilize the position of the meniscus of the ink inside the nozzle 21 when the ink droplets are continuously discharged. Therefore, it is possible to suppress the occurrence of variations in the discharging properties of the ink droplets when the ink droplets are continuously discharged.

In the recording head 1 of the present embodiment, the ratio r2/d2 of the diameter r2 of the second opening 212 to the depth d2 of the second nozzle portion 21*b* diameter r2 in the Z direction, which is the second axial direction, is preferably greater than or equal to 1.5 and is more preferably greater than or equal to 3. As described above, by forming the second nozzle portion 21*b* to have a shape that is long in the Y direction, which is the first axial direction, and short in the Z direction, which is the second axial direction, the ink flowing through the first flow path 201 in the Y direction easily enters the second nozzle portion 21*b*, and it is possible to generate a flow of the ink inside the second nozzle portion 21*b*.

In the recording head 1 of the present embodiment, the ratio M2/M1 of the inertance M2 of the second nozzle portion 21*b* to the inertance M1 of the first nozzle portion 21*a* is preferably 0.28 to 0.9. By defining the ratio of the inertance of the second nozzle portion 21*b* to the first nozzle portion 21*a* in this manner, it is possible to generate a flow of the ink inside the nozzle 21 and it is possible to stabilize the position of the meniscus of the ink inside the nozzle 21 to perform stabilizing of the continuous discharging of ink droplets.

Other Embodiments

Although the embodiments of the present disclosure are described above, the basic configuration of the present disclosure is not limited to the above-described embodiment.

For example, in Embodiment 1 described above, although the second opening 212 of the second nozzle portion 21*b* is formed to have a circular shape when viewed in plan view in the Z direction, the present disclosure is not particularly limited thereto, and for example, as illustrated in FIG. 6, the second opening 212 may be elliptical having a major axis in the Y direction. Here, the second opening 212 having an elliptical shape includes elliptical shapes, rounded-corner rectangles based on rectangles and having both end portions in the longitudinal direction be semicircular, egg shapes, and the like when the second opening 212 is viewed in plan view in the Z direction.

As described above, by adopting the second opening 212 which is elliptical and has a major axis in the Y direction, the ink flowing through the first flow path 201 in the Y direction easily enters the second nozzle portion 21*b*, and it is possible to generate a flow of the ink inside the second nozzle portion 21*b*. By adopting the second opening 212 which is elliptical and has a short axis in the X direction, it is not necessary to increase the width of the first flow path 201 in the X direction, and it is possible to densely dispose the first flow paths 201 in the X direction. Furthermore, by making the second opening 212 elliptical, it is possible to suppress the flow path resistance and the inertance of the second nozzle portion 21*b* being significantly reduced. In other words, this is because, when the second opening 212 of the second nozzle portion 21*b* is a circular shape having the same inner diameter as the major axis of the elliptical shape, the flow path resistance and inertance of the second nozzle portion 21*b* are significantly reduced. By making the second opening 212 an elliptical shape having the major axis in the Y direction, it is possible to suppress a significant reduction in the flow path resistance and the inertance of the second nozzle portion 21*b*, and to cause the ink to easily enter the second nozzle portion 21*b* to generate a flow of the ink inside the second nozzle portion 21*b*.

Figure 7:
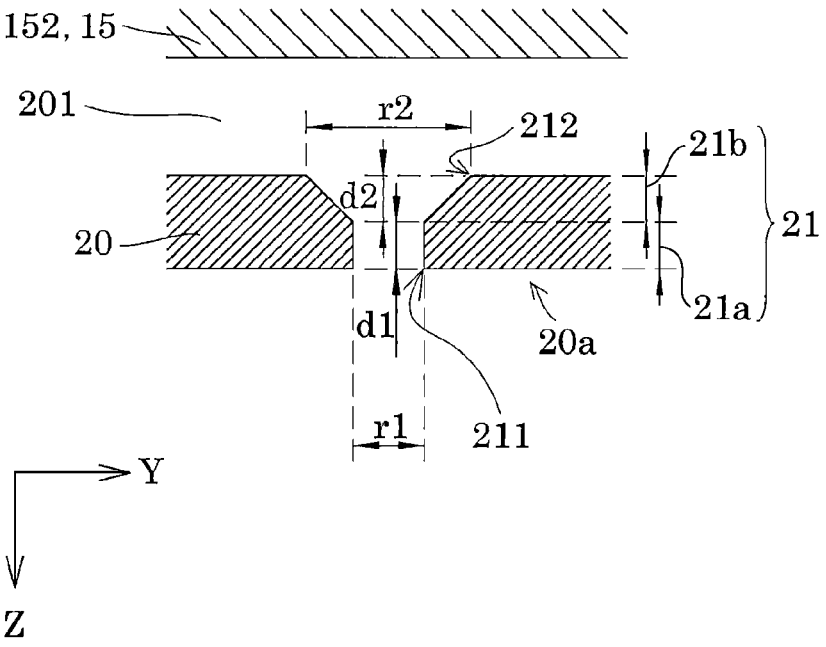
FIG. 7 is a sectional diagram of a recording head according to another embodiment.

In Embodiment 1 described above, by providing the first nozzle portion 21*a* and the second nozzle portion 21*b* to have the same opening shape over the Z direction, a level difference is provided between the first nozzle portion 21*a* and the second nozzle portion 21*b*. However, the configuration is not limited thereto, and for example, the inner surface of the second nozzle portion 21*b* may be an inclined surface inclined with respect to the Z direction as illustrated in FIG. 7. In other words, the opening area of the second nozzle portion 21*b* in the plane direction including the X direction and the Y direction may be provided to gradually decrease toward the first nozzle portion 21*a*. Accordingly, a level difference may not be formed between the first nozzle portion 21*a* and the second nozzle portion 21*b* and a continuous inner surface may be formed. In this manner, when the inner surfaces of the first nozzle portion 21*a* and the second nozzle portion 21*b* are continuous, the first nozzle portion 21*a* refers to a portion in which the opening shape is substantially the same over the Z direction.

For example, in the above-described embodiment, a configuration is exemplified in which the nozzles 21 are arranged in the X direction orthogonal to both the Y direction and the Z direction with the first axial direction as the Y direction and the second axial direction as the Z direction. However, the present disclosure is not particularly limited thereto. For example, the nozzles 21, the pressure chambers 12, and the like may be arranged side by side in a direction inclined with respect to the X direction in the in-plane direction of the nozzle surface 20*a*.

In the present embodiment, although the first flow path 201 of the individual flow path 200 and the second common liquid chamber 102 are directly coupled, the configuration is not particularly limited thereto, and another flow path extending in the Z direction, which is the second axial direction, may be provided between the first flow path 201 and the second common liquid chamber 102.

Figure 8:
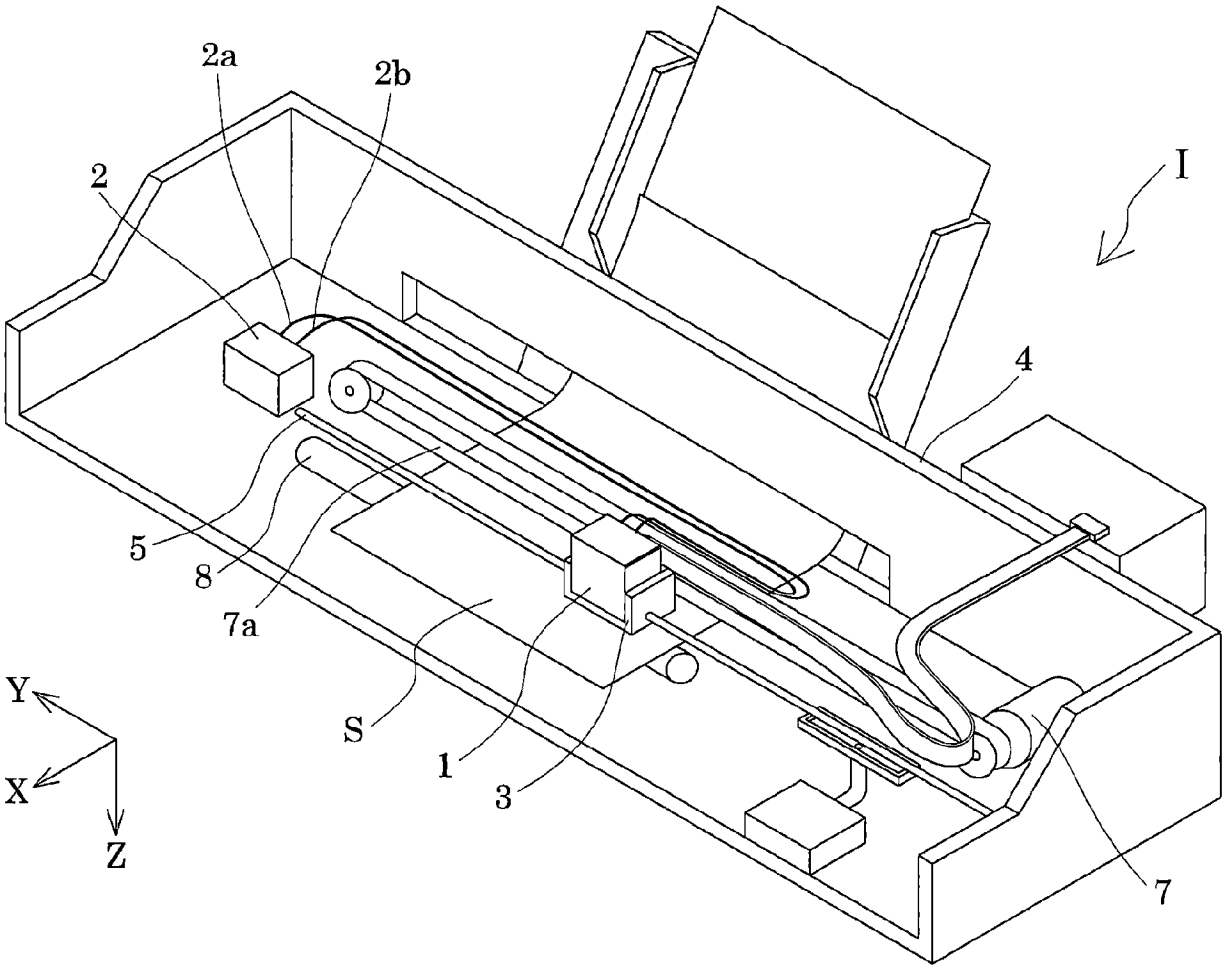
FIG. 8 is a perspective view illustrating a schematic configuration of a recording apparatus according to an embodiment.

Here, an example of an ink jet recording apparatus, which is an example of the liquid ejecting apparatus of the present embodiment, will be described with reference to FIG. 8. FIG. 8 is a perspective view illustrating a schematic configuration of the ink jet recording apparatus of the present disclosure.

As illustrated in FIG. 8, in an ink jet recording apparatus I, which is an example of a liquid ejecting apparatus, two or more recording heads 1 are mounted on a carriage 3. The carriage 3 on which the recording heads 1 are mounted is provided on a carriage shaft 5 attached to an apparatus main body 4 to move freely in the axial direction. In the present embodiment, the moving direction of the carriage 3 is the Y direction, which is the first axial direction.

The apparatus main body 4 is provided with a tank 2 which is a storage unit in which ink is stored as a liquid. The tank 2 is coupled to the recording head 1 via a supply pipe 2*a* such as a tube and the ink from the tank 2 is supplied to the recording head 1 via the supply pipe 2*a*. The recording head 1 and the tank 2 are coupled via a discharge pipe 2*b* such as a tube and the ink discharged from the recording head 1 is returned to the tank 2 via the discharge pipe 2*b*, that is, so-called circulation is performed. The tank 2 may be formed by two or more tanks.

The driving force of a drive motor 7 is transmitted to the carriage 3 via gears (not illustrated) and a timing belt 7*a*, and thus, the carriage 3 on which the recording head 1 is mounted is moved along the carriage shaft 5. On the other hand, the apparatus main body 4 is provided with a transport roller 8 which serves as a transport unit and a recording sheet S which is an ejection target medium such as paper is transported by the transport roller 8. The transport unit that transports the recording sheet S is not limited to the transport roller 8 and may be a belt, a drum, or the like. In the present embodiment, the transport direction of the recording sheet S is the X direction.

In the ink jet recording apparatus I described above, a configuration is exemplified in which the recording head 1 is mounted on the carriage 3 and moves in a main scanning direction. However, the configuration is not particularly limited thereto, and for example, it is possible to apply the present disclosure to a so-called line type recording apparatus in which the recording head 1 is fixed and the printing is performed by only moving the recording sheet S such as paper in the sub-scanning direction.

In each embodiment, the ink jet recording head is described as an example of the liquid ejecting head and the ink jet recording apparatus is described as an example of the liquid ejecting apparatus. However, the present disclosure widely targets liquid ejecting heads and liquid ejecting apparatuses in general, and naturally, it is possible to apply the present disclosure to a liquid ejecting head or a liquid ejecting apparatus that ejects a liquid other than the ink. Examples of other liquid ejecting heads include various recording heads used in image recording apparatuses such as printers, color material ejecting heads used in manufacturing color filters of liquid crystal displays and the like, electrode material ejection heads used for forming electrodes of organic EL displays, FEDs (field emission displays), and the like, and biological organic material ejection heads used for manufacturing biochips, and it is also possible to apply the present disclosure to a liquid ejecting apparatus provided with such a liquid ejecting head.

Figure 9:
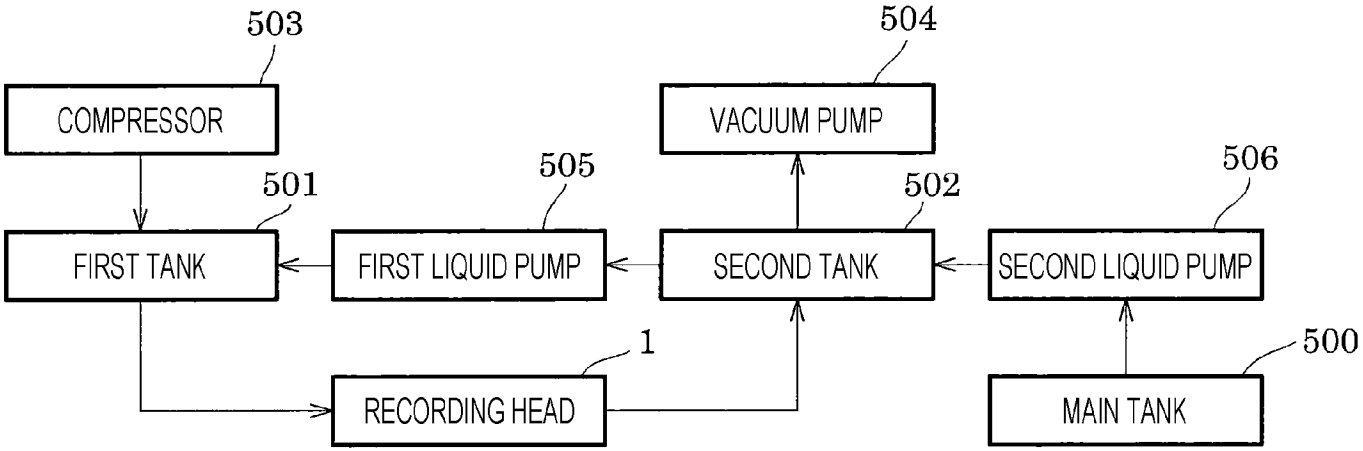
FIG. 9 is a block diagram illustrating a liquid ejecting system according to an embodiment.

Here, an example of the liquid ejecting system of the present embodiment will be described with reference to FIG. 9. FIG. 9 is a block diagram illustrating the liquid ejecting system of the ink jet recording apparatus which is the liquid ejecting apparatus of the present disclosure.

As illustrated in FIG. 9, the liquid ejecting system includes the recording head 1 and, as a mechanism for supplying the ink as the liquid to the supply port 43, collecting the ink from the discharge port 44, and circulating the ink, includes a main tank 500, a first tank 501, a second tank 502, a compressor 503, a vacuum pump 504, a first liquid pump 505, and a second liquid pump 506.

The recording head 1 and the compressor 503 are coupled to the first tank 501, and the ink in the first tank 501 is supplied to the recording head 1 at a predetermined pressure by the compressor 503.

The second tank 502 is coupled to the first tank 501 via the first liquid pump 505, and the ink in the second tank 502 is pumped to the first tank 501 by the first liquid pump 505.

The recording head 1 and the vacuum pump 504 are coupled to the second tank 502, and the ink of the recording head 1 is discharged to the second tank 502 at a predetermined negative pressure by the vacuum pump 504.

In other words, the ink is supplied from the first tank 501 to the recording head 1 and the ink is discharged from the recording head 1 to the second tank 502. The ink is circulated by the ink being pumped from the second tank 502 to the first tank 501 by the first liquid pump 505.

The main tank 500 is coupled to the second tank 502 via the second liquid pump 506, and an amount of the ink corresponding to that consumed by the recording head 1 is replenished in the second tank 502 from the main tank 500. The replenishment of the ink in the second tank 502 from the main tank 500 may be performed, for example, at a timing when the liquid level of the ink in the second tank 502 becomes lower than a predetermined height.

What is claimed is:

1. A liquid ejecting head comprising:

a first flow path extending in a first axial direction between a supply port and a discharge port; and a nozzle that is provided to branch from the first flow path and that discharges a liquid along a second axial direction orthogonal to the first axial direction, wherein the nozzle includes a first nozzle portion in which a first opening for discharging the liquid is formed and a second nozzle portion in which a second opening that is a coupling port with the first flow path is formed, and a diameter r2 of the second opening in the first axial direction is larger than a diameter r1 of the first opening in the first axial direction, wherein a ratio M2/M1 of an inertance M2 of the second nozzle portion to an inertance M1 of the first nozzle portion is 0.28 to 0.9.

2. The liquid ejecting head according to claim 1, wherein a ratio r2/r1 of the diameter r2 of the second opening to the diameter r1 of the first opening is greater than or equal to 2.

3. The liquid ejecting head according to claim 2, wherein the ratio r2/r1 of the diameter r2 of the second opening to the diameter r1 of the first opening is greater than or equal to 2.5.

4. The liquid ejecting head according to claim 1, wherein a ratio r2/r1 of the diameter r2 of the second opening to the diameter r1 of the first opening is less than or equal to 5.

5. The liquid ejecting head according to claim 4, wherein the ratio r2/r1 of the diameter r2 of the second opening to the diameter r1 of the first opening is less than or equal to 3.5.

6. The liquid ejecting head according to claim 1, wherein a ratio r2/d2 of the diameter r2 of the second opening to a depth d2 of the second nozzle portion in the second axial direction, is greater than or equal to 1.5.

7. The liquid ejecting head according to claim 6, wherein the ratio r2/d2 of the diameter r2 of the second opening to the depth d2 of the second nozzle portion in the second axial direction, is greater than or equal to 3.

8. The liquid ejecting head according to claim 1, wherein the second opening is an ellipse having a major axis in the first axial direction.

9. A liquid ejecting system comprising:

the liquid ejecting head according to claim 1, and a mechanism for supplying the liquid to the supply port, collecting the liquid from the discharge port, and circulating the liquid.

10. A liquid ejecting head comprising:

a first flow path extending in a first axial direction between a supply port and a discharge port; and a nozzle that is provided to branch from the first flow path and that discharges a liquid along a second axial direction orthogonal to the first axial direction, wherein the nozzle includes a first nozzle portion in which a first opening for discharging the liquid is formed and a second nozzle portion in which a second opening that is a coupling port with the first flow path is formed, and the first flow path is formed so as to flow liquid in the first axial direction, a diameter r2 of the second opening in the first axial direction is larger than a diameter r1 of the first opening in the first axial direction.

11. The liquid ejecting head according to claim 10, wherein a ratio r2/r1 of the diameter r2 of the second opening to the diameter r1 of the first opening is greater than or equal to 2.

12. The liquid ejecting head according to claim 11, wherein the ratio r2/r1 of the diameter r2 of the second opening to the diameter r1 of the first opening is greater than or equal to 2.5.

13. The liquid ejecting head according to claim 10, wherein a ratio r2/r1 of the diameter r2 of the second opening to the diameter r1 of the first opening is less than or equal to 5.

14. The liquid ejecting head according to claim 13, wherein the ratio r2/r1 of the diameter r2 of the second opening to the diameter r1 of the first opening is less than or equal to 3.5.

15. The liquid ejecting head according to claim 10, wherein a ratio r2/d2 of the diameter r2 of the second opening to a depth d2 of the second nozzle portion in the second axial direction, is greater than or equal to 1.5.

16. The liquid ejecting head according to claim 15, wherein the ratio r2/d2 of the diameter r2 of the second opening to the depth d2 of the second nozzle portion in the second axial direction, is greater than or equal to 3.

17. The liquid ejecting head according to claim 10, wherein the second opening is an ellipse having a major axis in the first axial direction.

18. A liquid ejecting system comprising:

the liquid ejecting head according to claim 10, and a mechanism for supplying the liquid to the supply port, collecting the liquid from the discharge port, and circulating the liquid.

19. The liquid ejecting head according to claim 1, further comprising:

a pressure chamber, a second flow path extending in the second axial direction, wherein one edge of the second flow path directly connects to the pressure chamber, and the other edge of the second flow path directly connects to the first flow path.

20. The liquid ejecting head according to claim 10, further comprising:

a pressure chamber, a second flow path extending in the second axial direction, wherein one edge of the second flow path directly connects to the pressure chamber, and the other edge of the second flow path directly connects to the first flow path.

* * * * *